United States Patent [19]

Day

[11] 3,970,813

[45] July 20, 1976

[54] APPARATUS FOR INDUCTIVELY HEATING THE END OF AN ELONGATED WORKPIECE

[75] Inventor: Paul L. Day, Parma, Ohio

[73] Assignee: Park-Ohio Industries, Inc., Cleveland, Ohio

[22] Filed: Jan. 9, 1975

[21] Appl. No.: 539,919

[52] U.S. Cl. ..... 219/10.57; 219/10.71; 219/10.79; 266/129

[51] Int. Cl.² ..... H05B 5/00; C21D 1/06; C21D 1/66

[58] Field of Search ..... 219/7.5, 10.41, 10.43, 219/10.57, 10.67, 10.69, 10.71, 10.79; 148/12.4, 143, 144, 145, 150, 153, 154, 155; 266/4 EI, 4 S, 5 EI

[56] References Cited

UNITED STATES PATENTS

| | | | |
|---|---|---|---|
| 3,337,200 | 8/1967 | Balzer | 219/10.43 X |
| 3,743,809 | 7/1973 | Delpaggio | 219/10.43 X |

*Primary Examiner*—Laramie E. Askin
*Attorney, Agent, or Firm*—Meyer, Tilberry & Body

[57] ABSTRACT

A method and apparatus for inductively heating the axial, generally circular end of at least two elongated workpieces having central axes wherein the ends terminate in generally flat surfaces perpendicular to the axes. The method and apparatus includes locating the workpieces in side-by-side relationship with the axial ends facing a given direction and the respective axes being generally parallel, providing generally circular inductors matching each of the ends of the workpieces and normally spaced axially therefrom, moving the inductors axially of the workpieces until each of the inductors contacts the flat surface of one of the axial ends, locking the inductors with respect to each other, retracting the locked inductors axially away from the flat surfaces a selected air gap distance, rotating the workpiece about the axes and energizing the inductors to inductively heat the axial ends of the workpieces preparatory to hardening.

9 Claims, 20 Drawing Figures

5
5
4
4
10
14
16
20
22
24
32
50
54
70
80
176
178
179
230
232
234
238
240
242
244
246
252
254
260
262
264
266
268
270
280
286
288
292
296
302
310
312
320
322
324
326
328
330
332
334
340
342
350
352
360
362
364
370
374
376
380
382
384
386
388
390
392
394
396
398
400
404
410
411
412
422
426
152
156
a
b
B

APPARATUS FOR INDUCTIVELY HEATING THE END OF AN ELONGATED WORKPIECE

This invention relates to the art of induction heating and more particularly to a method and apparatus for inductively heating the axial ends of an elongated workpiece.

The invention is particularly applicable for inductively heating the button portions of a flanged axle shaft and it will be described with particular reference thereto; however, it is appreciated that the invention has broader applications and may be used for heating the axial end of various elongated workpieces.

BACKGROUND OF INVENTION

In the production of flanged axle shafts for automobiles, the axle shaft often includes a button portion which is a cylindrical element having a generally flat outwardly facing surface and spaced from the splined section of the axle shafts by an undercut portion. This button is used for supporting the shaft within the differential and must be hardened and tempered for wear resistance and strength. In the past, several systems have been used for performing this process. Generally the buttons are heated separately by an induction heating coil and then quench hardened. Thereafter, tempering is accomplished by a furnace or a subsequent induction heating operation wherein the hardened button is tempered at a lower temperature than the hardening temperature. Since a single workpiece was processed by prior systems, a substantial amount of processing time was required and individual handling was necessitated. The present invention relates to an improved method and apparatus for accomplishing the hardening and tempering of the button portion of an axle shaft, which method and apparatus use induction heating and process several workpieces simultaneously and automatically.

STATEMENT OF INVENTION

In accordance with the invention, there is provided a method of inductively heating the axial, generally cylindrical ends of at least two elongated workpieces having central axes. The ends terminate in generally flat surfaces which are perpendicular to the axes of the workpieces. The method includes locating the workpieces in side-by-side relationship with the axial ends facing a given direction and with the axes generally parallel, providing a generally circular inductor matching each of the ends and normally spaced axially therefrom, moving the inductors axially of the workpiece until each of the inductors contacts the flat surface of one of the axial ends, locking the inductors with respect to each other, retracting the locked inductors axially away from the flat surfaces a selected distance corresponding to the air gap for induction heating, rotating the workpieces around the axes and engaging the inductors to inductively heat the axial ends of the workpieces as they are rotating. By this method, the axial ends are heated to a quench hardening temperature and are then quench hardened, preferably by a liquid spray. Thereafter, the same apparatus and inductors can be used to inductively heat the axial ends to a lower temperature than the hardening temperature to provide a tempering of the axial ends if tempering is desired.

In accordance with another aspect of the invention, there is provided an apparatus for inductively heating the axial, generally cylindrical end of an elongated workpiece having a central axis wherein the end terminates in a generally flat surface generally perpendicular to the axis of the workpiece. This apparatus comprises means for mounting the workpiece for rotation about the axis, means for rotating the workpiece about this axis, a generally circular inductor matching the axial end, means for mounting the inductor generally concentric with the axis, means for moving the inductor along the axis from a remote position to a position contacting the surface, means for retracting the inductor along an axis away from the surface a preselected air gap distance, and means for energizing an inductor when the inductor is in the retracted position and while the workpiece is rotating.

In accordance with another aspect of the invention, two workpieces are processed by the above apparatus at the same time and the required two inductors are locked together prior to being moved by the retracting means.

In accordance with another aspect of the invention there is provided a connection between the movable inductor as described above and a stationary power supply, which connection includes a clampable, reciprocal joint.

The primary object of the present invention is the provision of a method and apparatus for inductively heating the axial ends of elongated workpieces, which method and apparatus reduces the handling of the workpieces, provides uniform results, and increases the production rate.

Yet another object of the present invention is the provision of a method and apparatus for inductively heating the axial ends of elongated workpieces, which method and apparatus allows processing of two or more elongated workpieces simultaneously.

Still a further object of the present invention is the provision of a method and apparatus as defined above which can process more than one workpiece and compensate for variations in the axial lengths of the workpieces.

These and other objects and advantages will become apparent from the following description taken together with the accompanying drawings in which:

BRIEF DESCRIPTION OF DRAWINGS

FIG. 9 is an enlarged pictorial view showing the driving element of the rotating means and taken generally along 9—9 of FIG. 1;

GENERAL DESCRIPTION OF PREFERRED EMBODIMENT

Figure 1:
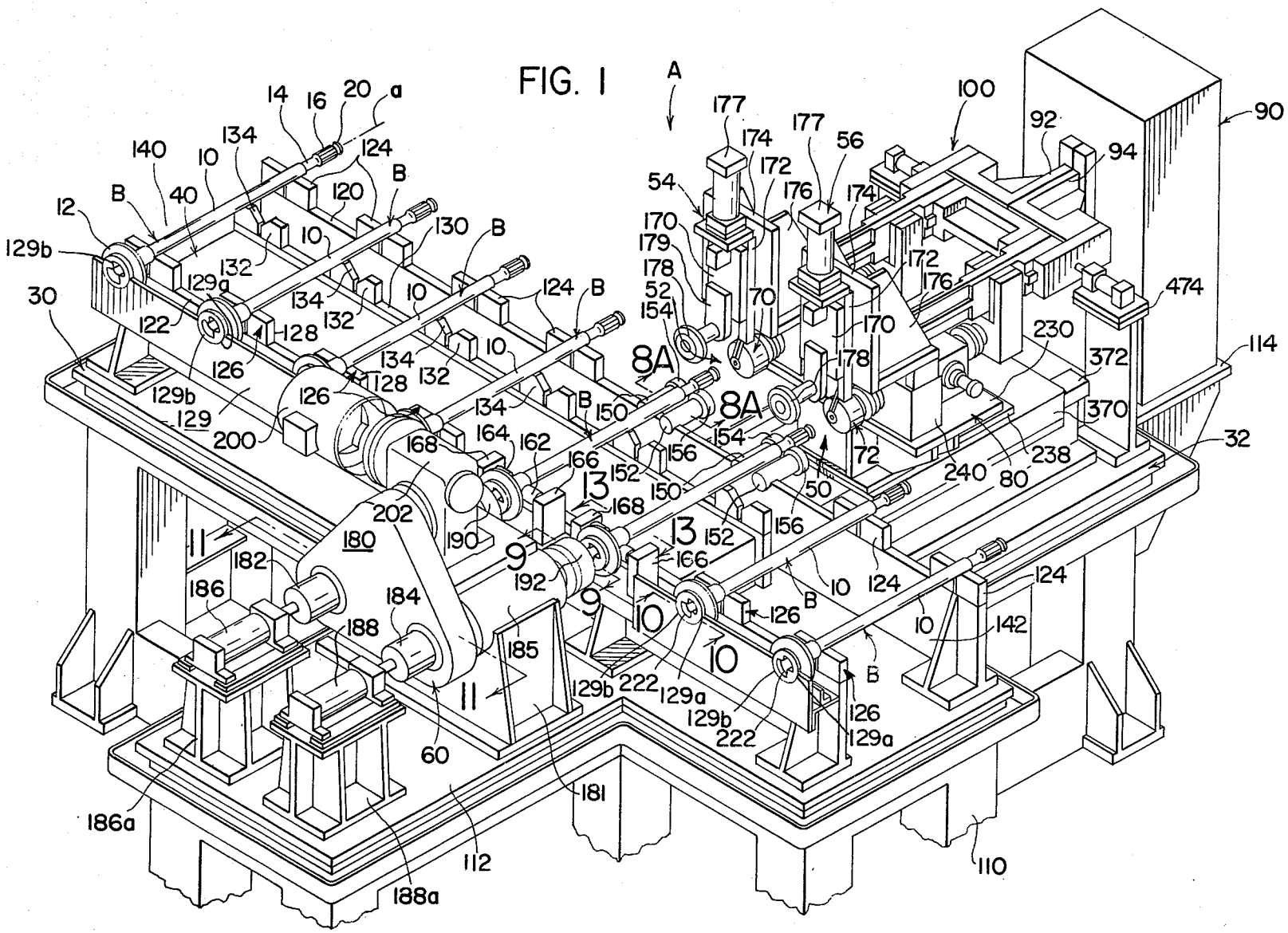
FIG. 1 is a pictorial view of the preferred embodiment of the invention.

Referring now to the drawings wherein the showings are for the purpose of illustrating a preferred embodiment of the invention and not for the purpose of limiting same, FIG. 1 shows an apparatus A for inductively heating one axial end of the workpieces B. These workpieces, in accordance with the preferred embodiment of the invention, are flanged axle shafts each including a body portion 10, a flange 12 at one axial end, undercut portion 14, splined segment 16 and a button 20 at the opposite end from flange 12. The button 20 is defined by undercut portion 22 and includes a generally flat surface 24 facing axially from the workpiece B and generally perpendicular to the elongated axis a of the workpiece. Of course, a centering hole can be provided in flat surface 24. The generally flat surface 24 may be somewhat curved as long as it provides a surface facing outwardly from the workpiece B. The apparatus A is used to harden and temper the button 20 which is formed from steel and is generally heated to 1700°F and quench hardened and then heated to approximately 500° and allowed to cool. Other temperatures could be used in accordance with the requirements of the steel to be hardened and tempered. These temperatures are well known for each of the various steels used in axle shafts and other similar elongated workpieces. The button 20 is generally cylindrical and has a known outer diameter. In accordance with the preferred embodiment of the invention, the apparatus A includes a base plate 30 for supporting a portion of the apparatus, a base plate 32 for supporting another portion of the apparatus, spaced heating stations 50, 52, hold-downs 54, 56 for these heated stations, a rotating mechanism 60, heating units 70, 72, a support frame and moving mechanism 80 for the heating units, a power supply illustrated as a transformer 90 and schematically illustrated in FIG. 6 as a generator, and power connector 100 for connecting the power supply to the heating units. In the preferred embodiment of the invention, two side-by-side heating units are illustrated; however more than two stations could be used in practicing the invention. In addition, some aspects of the invention could be used for a single heating station device, even though the invention is primarily adapted for use in heating the axial end of two or more workpieces simultaneously.

The base plates 30, 32 used to support the other components of apparatus A as best shown in FIG. 1, are supported by a lower support structure 110 which can take a variety of structural forms. Base plate 30 includes an extension 112 for supporting the rotating mechanism 60. In a like manner, an extension 114 of base plate 32 is used to support power supply 90, shown in FIG. 1 as a transformer, which transformer is powered by any high frequency power supply in accordance with normal induction heating practice.

CONVEYOR

Referring now to the conveyor 40, various types of conveyors could be used; however, in accordance with the illustrated embodiment of the invention, conveyor 40 is a walking beam type which includes two spaced, stationary beams 120, 122. These beams include spaced workpiece receiving nests 124, 126, respectively. Nests 126 are formed by a forward element 128 engaging the cylindrical portion of the workpiece and a plate 129 having semicircular recesses 129a engaging extension 129b of workpieces B. A pair of walking beams 130, only one of which is shown, includes nests 132. Of course, a nest is provided on each of the two walking beams to engage the cylindrical portion 10 of workpiece B, in accordance with normal walking beam construction. The nests 132 include V-shaped notches 134, as shown in FIG. 1. The operation of the walking beams 130 progress workpiece B from the loading end 140 of apparatus A, to the heating stations 50, 52 and then to the unloading end 142. The action of a walking beam is well known in the conveying and induction heating arts. Beams 130 move upwardly to remove workpieces B from the nests 124, 126. The beams are then moved toward the unloading position 142 a distance to progress the workpieces a distance corresponding to the space between adjacent nests 124, 126. Beams 130 are then moved downwardly to deposit the workpieces on the next stationary nests. This action is repeated twice to remove the two heated workpieces from the heating stations 50, 52 and deposit them at the unloading position or end 142 of apparatus A. At the same time, two unprocessed workpieces are moved to the heating stations 50, 52. The processed workpieces are removed from apparatus A by any appropriate mechanism. In a like manner, any appropriate device can be used for depositing two unprocessed workpieces at loading end 140 after walking beam conveyor 40 has cycled twice.

WORKPIECE SUPPORTING STRUCTURE

Figures 3, 3A:
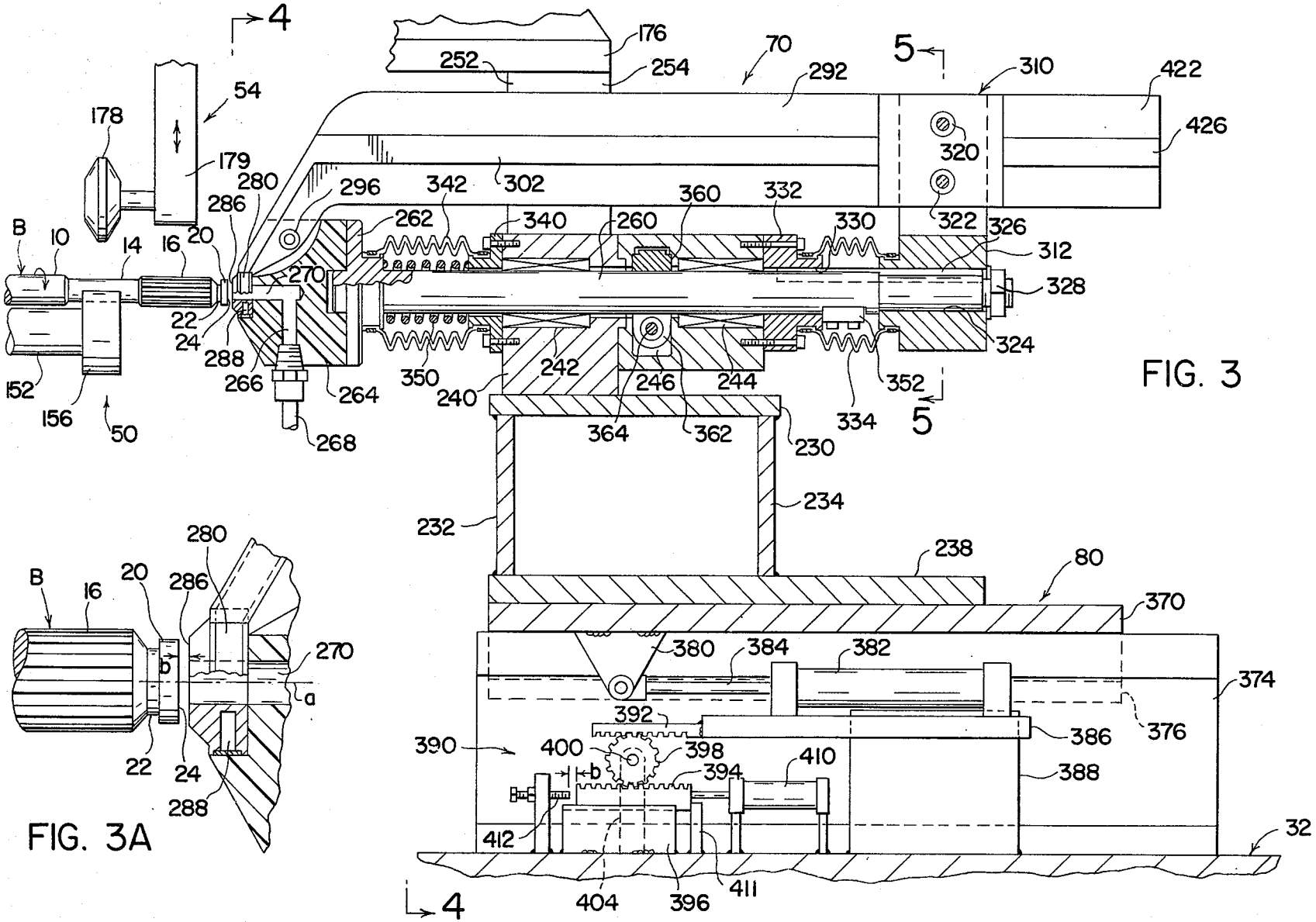
FIG. 3 is a cross-sectional view taken generally along line 3—3 of FIG. 2.
FIG. 3A is an enlarged partial view showing the inductor of the preferred embodiment.
Figure 8:
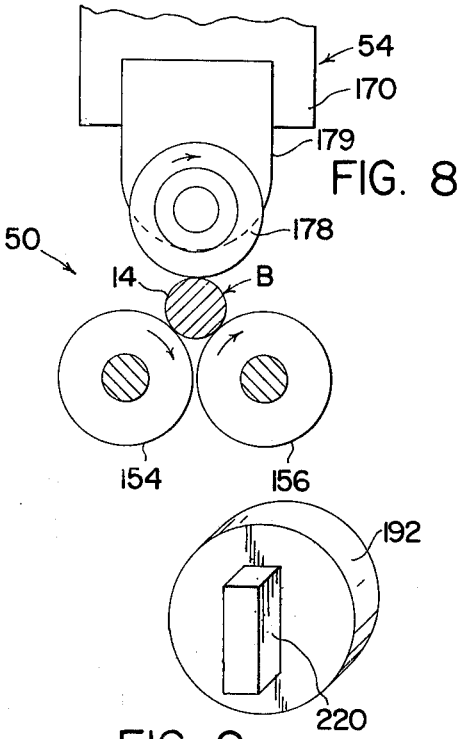
FIGS. 8 and 8A are operational views taken generally along line 8A—8A of FIG. 1.
Figure 8A:
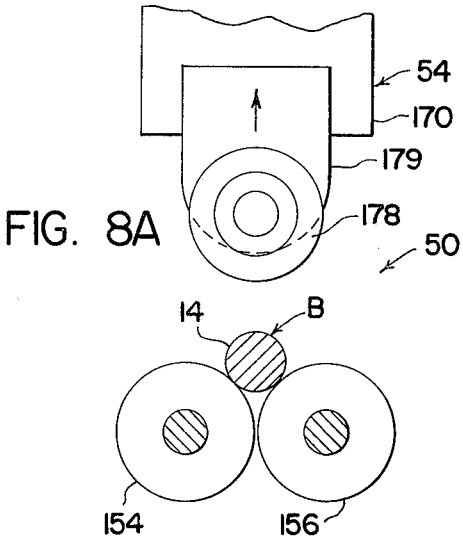

Referring now to the heating stations 50, 52, the workpiece supporting nests and related structure at the heating stations for supporting the workpieces are illustrated in FIGS. 1, 3, 8, 8A and 13. As best shown in FIGS. 1, 3 and 8, journals 150, 152 rotatably receive rollers 154, 156, respectively. These rollers engage the lower side of the workpieces to support the workpieces at the heating stations. At the heating stations, the flanged ends of the workpieces are supported on V-shaped notches 160, best shown in FIG. 13, which notches generally correspond to the structure of nests 126, on the stationary beam 122 with sidewalls 160a, 160b having a height to clear transverse rolls 162, 164 supported on journal blocks 166, 168. These rolls rotate about an axis generally perpendicular to the axis of workpieces B. The rolls are used to engage flange 12 during the rotation of the workpiece B in the heating and quenching cycle, in a manner to be described later. Hold Downs 54, 56 are positioned above a set of rollers 154, 156 at each of the heating stations 50, 52. The hold downs are best shown in FIGS. 1, 3 and 8. Since the hold downs are substantially the same, hold down 54 will be explained in detail, and this description will apply equally to hold down 56. The slide 170, shown in FIG. 1, includes a rearward extension, not shown, slidably received between two, spaced, fixed rails 172 which, in turn, are secured to a fixed plate 174. This plate is secured to stand 176. A cylinder 177 reciprocates slide 170, which carries a roll 178 rotatably mounted in journal 179 secured to slide 170. As shown in FIG. 8, the rod of cylinder 177 moves hold down roll 178 into engagement with the undercut portion 14 above a pair of rolls 154, 156. This completes the locating and holding function of workpieces B at the axial end adjacent to the button 20 at the heating stations.

ROTATING MECHANISM

Figure 10:
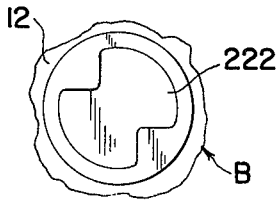
FIG. 10 is an end view showing a portion of the workpiece to which the drive element of FIG. 9 is received and taken generally along line 10—10 of FIG. 1.
Figure 11:
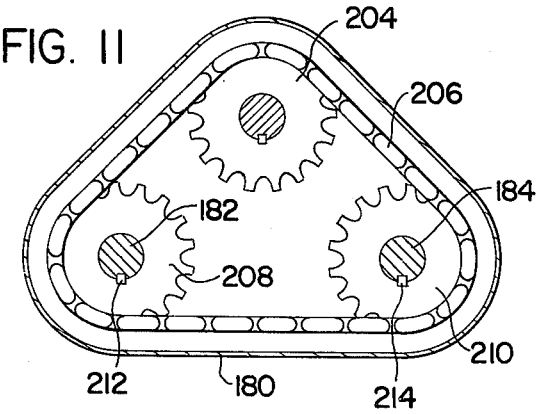
FIG. 11 is a schematic view of the driving arrangement used in the preferred embodiment of the invention and is taken generally along line 11—11 of FIG. 1.

Referring now to the workpiece rotating mechanism 60, best shown in FIGS. 1 and 11, this mechanism is used to engage and rotate the workpieces supported at the heating stations 50, 52. A variety of structural arrangements could be used for this mechanism; however, in accordance with the illustrated embodiment, a housing 180 is supported on stand 181 secured to the extension 112 of base plate 30. Reciprocally mounted plungers 182, 184 move in tubes 185, only one of which is shown. Cylinders 186, 188 supported on stands 186*a*, 188*a*, respectively, selectively move plungers 182, 184 within the support tubes 185. Heads 190, 192 best shown in FIG. 1, are carried by the plungers 182, 184 at opposite ends from cylinders 186, 188. These heads engage the flanged ends of workpieces B to rotate the workpieces about their longitudinal axes a. A selectively energized electric motor 200 drives a gear reducer 202 having an output sprocket 204, best shown in FIG. 11. This sprocket drives chain 206 connected with sprockets 208, 210 which reciprocally receive plungers 182, 184, respectively. Keys 212, 214 allow reciprocation of plungers 182, 184 within sprockets 208, 210 without losing a driving connection between the sprockets and the plungers. In this manner, the sprockets remain generally fixed in an axial direction and the plungers 182, 184 are selectively moved therein by cylinders 186, 188 to engage the workpiece by heads 190, 192. As shown in FIG. 9, head 192 includes an elongated protrusion 220 which matches a recess 222 on flange 12 of the workpiece, as best shown in FIGS. 1 and 10. This provides a driving connection between the heads 190, 192 and the workpieces B. Forward movement of heads 190, 192 forces protrusions 220 into recesses 222 for rotating the workpieces. This forward movement of the heads 190, 192 forces flange 12 into engagement with rolls 162, 164. This provides a positioning of the workpieces B in an axial direction. Since there are some manufacturing tolerances, buttons 20 at the opposite ends of workpieces B in the two heating stations may not be in exact alignment. Apparatus A, in accordance with an aspect of the invention, provides an arrangement to compensate for any manufacturing tolerances and thus different axial positions of buttons 20 of the two simultaneously heated workpieces B. The axial spacing of the workpieces due to manufacturing tolerances or other reasons, is schematically illustrated in FIGS. 12A–D which will be used subsequently to explain the compensating characteristics of the present invention.

HEATING UNITS

Figure 4:
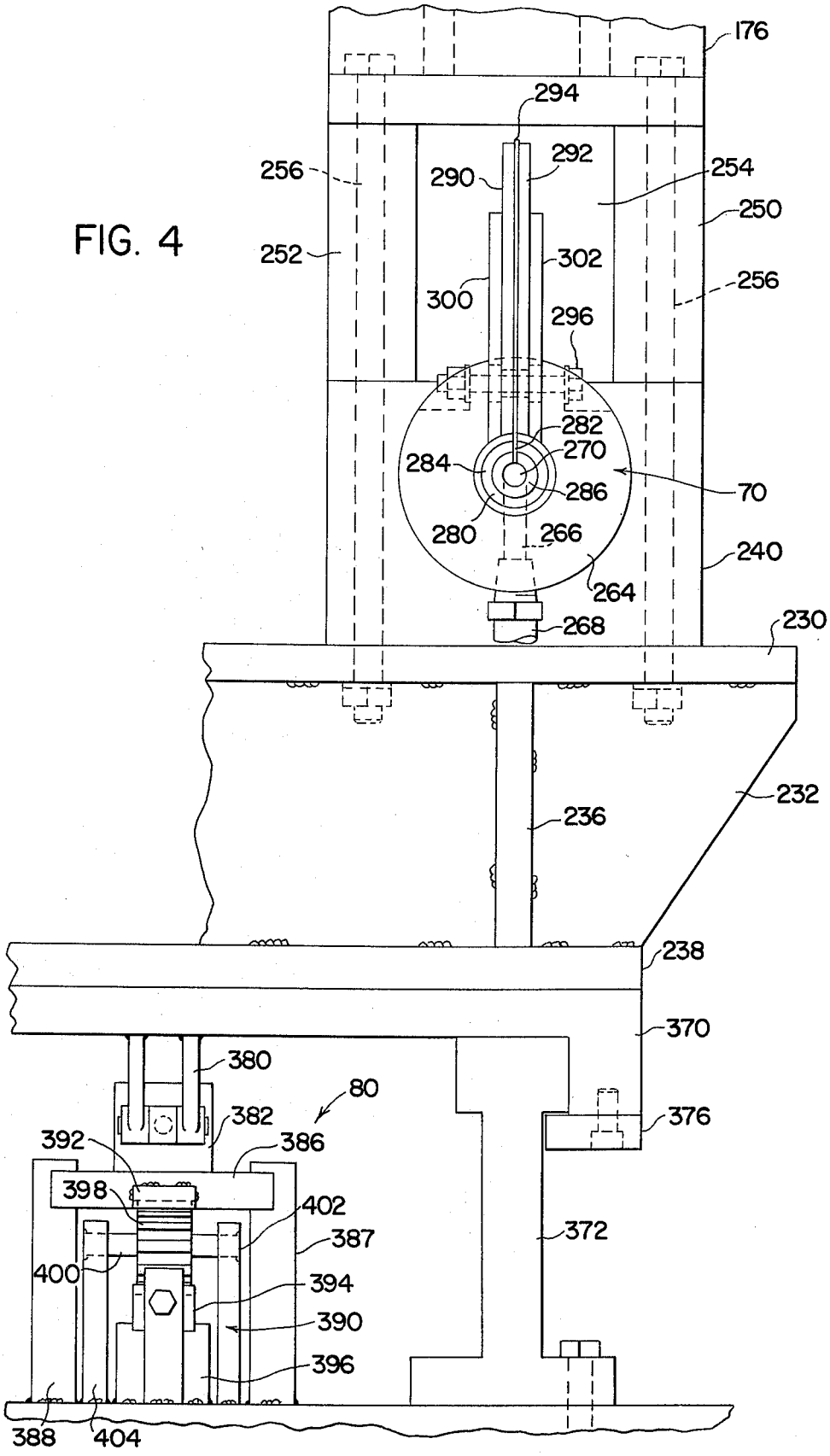
FIG. 4 is a front elevational view taken generally along line 4—4 of FIG. 3.
Figure 5:
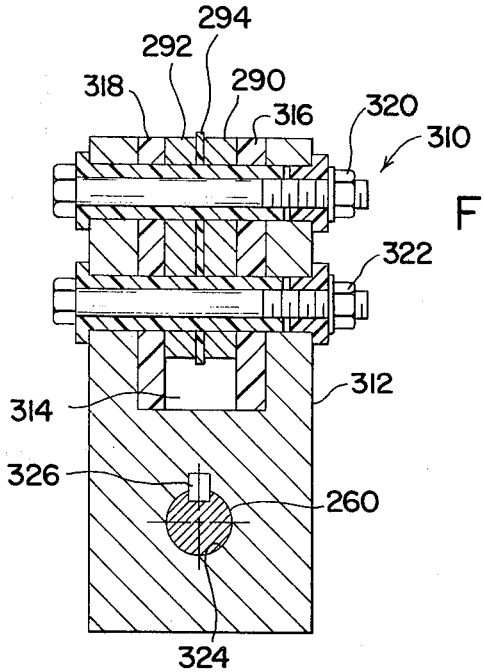
FIG. 5 is an enlarged cross-sectional view taken generally along line 5—5 of FIG. 3.

Referring now to the heating units 70, 72, only unit 70 will be described in detail and this description will apply equally to the other unit 72. Of course, more than two side-by-side heating units could be used for simultaneously heating any number of buttons 20 on workpieces B. In the preferred embodiment, only two such heating units are employed. These heating units are best shown in FIGS. 1, 2, 3, and 4. Both heating units are supported on a common base plate 230 which is moved in unison in a manner to be described later. This plate is supported on cross beams 232, 234, shown in FIG. 3. Two or more vertical support brackets 236 are used to reinforce the support structure for heating units 70, 72. This support structure is secured to a lower plate 238 attached to the upper portion of the support frame and moving mechanism 80 which will be described later. Referring now to the individual heating unit 70, as shown in FIG. 3, this unit includes a support block 240 which is somewhat hollowed to provide recesses for bearings 242, 244 and to provide a central recess 246 for a purpose to be explained later. Stands 250, 252 are supported on the upper portion of block 240 to define a central recess or opening 254. These stands and the support block 240 are secured onto plate 230 by a plurality of vertically extending bolts 256 which extend through the stand 176 supporting the hold down 54 at station 50. A rod-like element 260 is reciprocally mounted within bearings 242, 244, as shown in FIG. 3. One end of the rod-like element includes a support head 262 for mounting an insulated carrier 264. The carrier includes a center bore 266 for directing a quenching liquid from an inlet 268 to an outlet 270. This liquid is used for quenching the button 20 after it has been heated to a hardness temperature by a generally circular inductor 280, best shown in FIG. 3A. This inductor includes a gap 282, best shown in FIGS. 2 and 4, to form the inductor 280 in an electrical loop configuration as is standard in the induction heating art. The forward facing portion of inductor 280 is contoured to provide a conical extension 284 having an outwardly facing surface 286 generally matching button 20. This surface 286 has an outer diameter generally the same as the known outer diameter of button 20; however, it can be slightly different in diameter. Of course, the surface 286 is ring shaped as shown in FIG. 4 to accommodate the outlet 270 in the quenching fluid passage through carrier 264. Inductor 280 includes a standard internal passage 288 to allow circulation of the coolant liquid through the loop forming the inductor at least during the heating cycle to prevent overheating of the inductor in accordance with normal induction heating practice. Inductor 280 at the gap 282 is connected with input leads 290, 292 which are generally flat plates or bars shaped as shown best in FIG. 3. These bars are separated by insulation material 294 and generally extend coterminously with the rod-like element 260 from the carrier 264 to beyond the outer end of the rod-like element, as shown in FIG. 3. These two leads with the dividing insulator 294 maintain the electrical loop of inductor 280 and extend rearwardly as a somewhat single unit to provide an input element for the inductor. An insulated bolt 296 secures the carrier and leads 290, 292 as a unit at the forward end of rod-like element 260. Coolant lines 300, 302 on the opposite sides of plates or bars 290, 292 provide coolant paths to and from inductor 280. One of these lines has an appropriate coolant input and the other has a coolant output. They are both connected with the internal passage 288 for circulating coolant along bars 290, 292 and around inductor 280, at least during the heating cycle. The coolant inlets to lines 300, 302 are not illustrated since they may be provided by taps at various locations along these lines and do not form a part of the present invention. The rear end of rod-like element 260 is provided a rear support 310 for connecting the leads 290, 292 with rear end of element 260. This rear support of leads 290, 292 could take a variety of structural configurations; however, in accordance with the illustrated embodiment of the invention, as is best shown in FIGS. 3 and 5, rear support 310 includes a block 312 having a central recess 314. This recess receives the two spaced plates or bars 290, 292 electrically connected with inductor 280. Insulation plates 316, 318, as shown in FIG. 5, and insulated bolts 320, 322 secure leads 290, 292 fixedly with respect to block 312. At the lower end of block 312, there is provided a bore 324 in which a reduced portion of rod-like element 260 extends. This reduced portion is locked from rotation by a key 326 extending within a keyway of block 312. Nut 328 is threadably received upon the terminal end of element 260 and holds the element fixedly with respect to block 312 by using the shoulder defined by the reduced portion of element 260. As so far described, element 260 can reciprocate within block 240. This will cause like reciprocation of plates 290, 292 secured above element 260 and extending through opening 254. Key 326 extends into a slot 330 of an end cap 332 secured to the right end of block 240. This cap also retains reciprocating journal or bearing 244. A rear boot 334 extends between cap 332 and the front portion of block 312, as best shown in FIG. 3. A cap 340 similar to cap 332 is provided at the opposite end of block 240 to hold bearing or journal 242 in place within the block. The front boot 342 extends from support head 262 to cap 340. The biasing spring 350 biases rod-like element 260 to the left, as shown in FIG. 3. This spring extends between support head 262 and an outwardly facing shoulder of cap 340. This spring continues to bias the element 260 and all structures secured thereto to the left toward the workpiece B. An appropriate stop 352 is secured onto the rear end of element 260 between cap 332 and block 312. This stop engages the rearwardly facing surface of cap 332 to limit the amount of forward movement of element 260 by the biasing spring 350. The amount of backward movement against the action of spring 350 is limited basically by the spring 350 and the spacing between head 262 and cap 340.

As so far explained, rod-like element 260 can be forced rearwardly against spring 350. The forward movement of the element is limited by stop 352. The purpose of these functions will be explained later.

Figure 2:
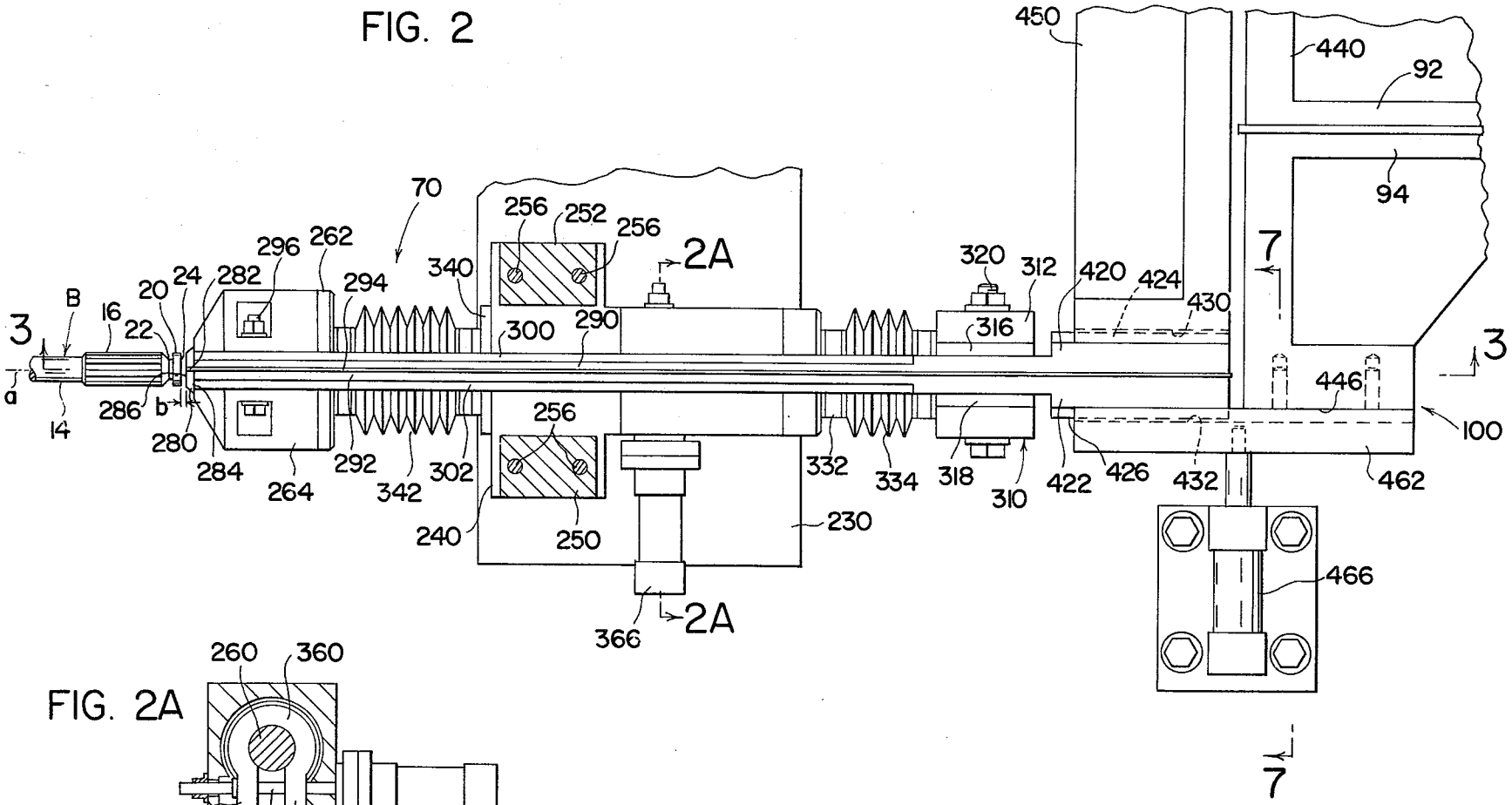
FIG. 2 is an enlarged, partial elevational view showing one inductor assembly and its relationship with the power supply and workpieces.
Figure 2A:
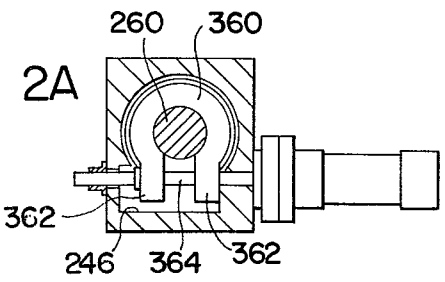
FIG. 2A is an enlarged cross-sectional view taken generally along line 2A—2A of FIG. 2.

Referring now to the center recess 246 within block 240, as shown in FIG. 3, this recess holds a double ended spring clip 360 having two ends 362, best shown in FIG. 2A. A clamping rod 364 is controlled by cylinder 366, as shown in FIG. 2. When the clamping rod is retracted, two spaced ends 362 are pulled together to clamp spring clip 360 around element 260. This locks the element with respect to block 240. Reciprocation of element 260 within block 240 is thus prevented. Consequently, at any reciprocated position of element 260, retraction of cylinder 366 locks the element with respect to block 240. This type of locking arrangement is known for reciprocating members and is only one of many which could be used. When rod 364 is extended by cylinder 366, ends 362 are shifted apart to release element 260 for reciprocation with respect to block 240. By providing this arrangement, the block 240 may be reciprocated by mechanism 80, to be described later, until surface 286 of inductor 280 contacts surface 24 of button 20. Continued forward movement toward the button by block 240 causes compression of spring 350. When the desired amount of forward movement of block 240 is effected, cylinder 366 actuates spring clip 360 to lock element 260 with respect to block 240. Thereafter, movement of the block away from the workpiece draws the inductor away from button 20 a distance determined by the rearward retraction of block 240. At this time, element 260 moves with the block because of the locking action of clip 360. This function will be explained later in connection with the operation of apparatus A as shown in FIGS. 12A–D.

SUPPORT FRAME AND MOVING MECHANISM

The support frame and move mechanism 80 best shown in FIGS. 3 and 4 is used to support induction heating units 70, 72 and to move the units by way of lower plate 238 toward and away from workpieces B supported on apparatus A. A variety of mechanisms could be used for accomplishing the proper movement in accordance with the present invention; however, in accordance with the illustrated embodiment, a common plate 370 supports lower plate 238 and is reciprocally mounted on spaced rails 372, 374. Keepers 376 hold the plates 360 onto the rails and allow reciprocal movement toward and away from the workpieces as shown in FIG. 3. Secured below plate 370 is a trunnion 380 which is moved by cylinder 382 through a rod 384. Cylinder 382 is supported onto a reciprocal plate 386 movable within notches on spaced stands 387, 388, as best shown in FIG. 4. These stands are stationary and are mounted on base plate 32. In operation of the moving mechanism 80 as so far described, plate 386 is held stationary by an arrangement to be described later. When rod 384 is extended from cylinder 382, trunnion 380 forces plate 370 forward. This moves both heating units 70, 72 toward their respective buttons 20. As each of the inductors 280 engages surface 24 of the respective workpieces, forward movement of the inductor is halted. This stops forward movement of element 260. Since there has been no clamping of clip 360, block 240 continues to move base plate 370. After both of the inductors have engaged the buttons, and the two springs 350 have been compressed, forward movement of trunnion 380 is stopped by halting the forward movement of rod 384. In this position, each of the two inductors 280 is in engagement with a button 20, irrespective of slight axial misalignment of the buttons. Cylinder 366 of each heating unit 50, 52 is then energized to lock element 260 with respect to block 240. It is in this position that the additional function of mechanism 80 comes into play. This additional function is the retraction function to retract the two blocks 240 away from workpieces B a distance corresponding to the desired air gap, which is generally in the range of 0.40 inches and is represented by the dimension *b* in FIGS. 2, 3A and 12D. This retracting mechanism 390 is best shown in FIG. 3 and includes a first rack 392 carried on the forward end of plate 386. The second rack 394 is reciprocally mounted within a block 396 secured to base plate 32. A pinion 398 engaging racks 392, 394 is journalled on a shaft 400 supported on spaced bars 402, 404 secured to base plate 32. A cylinder 410 also supported on base plate 32 reciprocates rack 394 between fixed stop 411 and adjustable stop 412.

In the operation of cylinder 382, cylinder 410 is in the position shown in FIG. 3 which holds rack 394 against stop 411. This holds rack 392 in a fixed position determined by pinion 396. Consequently, plate 386 is stationary during operation of cylinder 382. After the cylinder has moved both inductors into engagement with buttons 20 of the workpieces, spring clips 360 are contracted to lock elements 260 with respect to blocks 240. At this time, cylinder 410 is energized to push rack 394 forward as shown in FIG. 3. Forward movement is the distance b determined by the adjustable stop 412. This forward movement of rack 394 causes rearward movement of rack 392. This rearward movement shifts plate 386 to the right as shown in FIG. 3 a distance corresponding to the movement of rack 394. Trunnion 380 is pulled to the right, which retracts the locked element 260 from buttons 20 a distance determined by the adjustable stop 412. This distance corresponds to the desired air gap for the heating operation. After the retraction operation, power supply 90 energizes inductors 280 with a high energy alternating current. In the preferred embodiment, the heating operation is accomplished at approximately 50 kilowatts of power. After the desired time necessary to heat buttons 20 to approximately 1750°F, the heating operation is terminated. Thereafter, quenching fluid is forced through the inlets 268 and from outlets 270 for the purpose of quenching the heated buttons. After the quenching operation, inductors 280 are again energized with a low power, such as approximately 12–15 kilowatts. This low power is continued until the quench hardened buttons 20 are heated to a temperature of approximately 500°F. Thereafter, the low power heating cycle is discontinued to allow tempering of the buttons 20.

SEQUENCE OF OPERATION

Figure 12A:
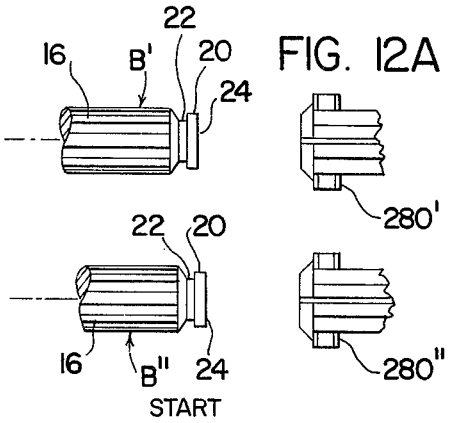
FIGS. 12A–D are operating views showing various positions of the inductors with respect to the ends of the workpieces during the operation of the apparatus shown in FIG. 1; and, FIG. 13 is an enlarged partial view taken generally along line 13—13 of FIG. 1.
Figure 12B:
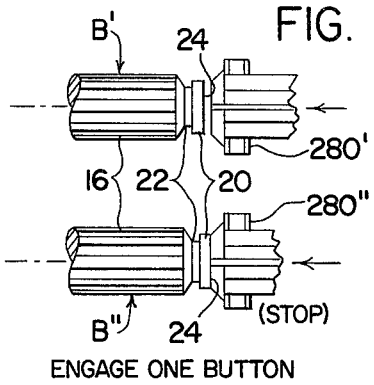
Figure 13:
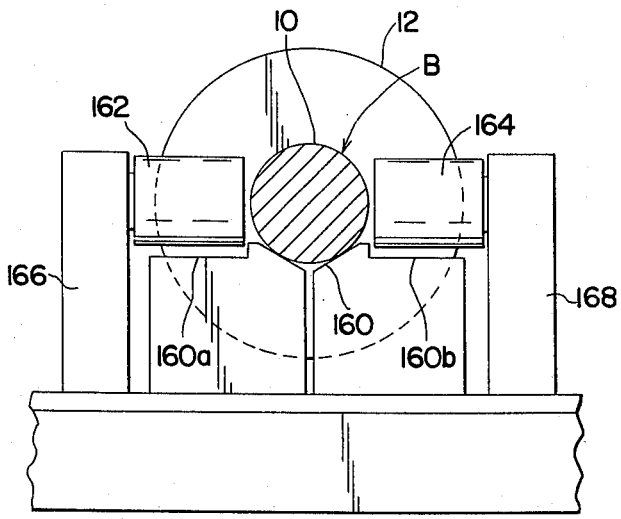
Figure 12C:
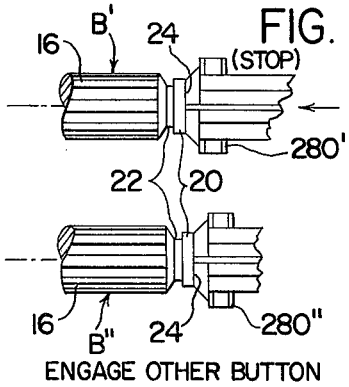
Figure 12D:
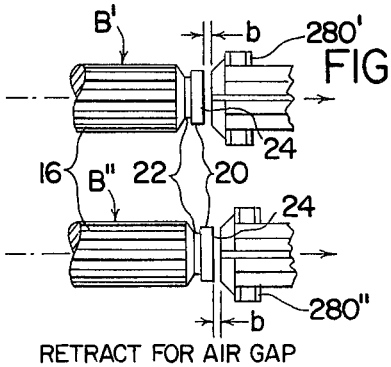

The sequence of operation is schematically illustrated in FIGS. 12A–D. In these figures, two side-by-side workpieces B′, B″ are illustrated as being axially offset to provide axially offset buttons 20. Referring now to FIG. 12A, the start of the apparatus A is illustrated. Since locking clips 360 are released, elements 260 of heating units 70, 72 are released to be moved forward by biasing springs 350. Thus, the inductors 280′, 280″ are approximately aligned with respect to each other. Thereafter, cylinder 382 starts forward movement of the heating units and, thus, inductors 280′, 280″ toward the workpieces B′, B″. As the movement of the inductors toward the workpieces continues, inductor 280″ engages the button of workpiece B″ which extends outwardly farther than the button of the other workpiece. This is shown in FIG. 12B. At this time, continued operation of cylinder 382 compresses spring 350 associated with inductor 280″ and allows continued movement of inductor 280′ toward the workpiece B′. When the button of the second workpiece is engaged as shown in FIG. 12C, spring 350 of the other heating unit is compressed. Thus, forward movement of the inductors 280′, 280″ is stopped even though cylinder 382 continues to move forward. After a predetermined amount of movement determined by the stroke of cylinder 382, the cylinder is stopped. Thereafter, clips 360 of the two heating units are actuated by cylinders 366 to clamp elements 260 with respect to blocks 240. Thereafter, cylinder 410 is energized to shift rack 394 against adjustable stop 412. This moves inductors 280′, 280″ away from buttons 20 of workpieces B′, B″ a distance corresponding to the desired air gap *b*. This is shown in FIG. 12D. Thus, the desired air gap is provided between the buttons and the inductors, irrespective of slight axial misalignment of the adjacent buttons of workpieces B′, B″. When the inductors are in the position shown in FIG. 12D, the high powered heating, liquid quenching, and low powered tempering cycles are performed in accordance with normal induction heating practice. During the two heating operations, and the quenching operation holds down 54, 56 support the workpieces at the button ends and rotating mechanism 60 rotates the workpieces. This assures uniform processing of the buttons during both heating and quenching of the buttons. In accordance with the illustrated embodiment, the hold downs 54, 56 are not shifted down by energizing cylinders 177 until the position shown in FIG. 12D is assumed. The hold downs are carried by blocks 240 and move with the blocks during the establishment of the air gap as shown in FIGS. 12A–D. After the tempering operation, cylinders 177 are retracted first. Thereafter, cylinders 382, 410 are retracted to return the inductors to the position shown in FIG. 12A. At this time, cylinders 186, 188 are retracted to disengage the heads 190, 192 from the flanges 12 of the workpieces. At this time, conveyor 40 removes the processed workpieces and inserts unprocessed workpieces in the heating station for subsequent processing in accordance with the above description. This procedure is continued so that subsequent workpieces are processed automatically by apparatus A.

POWER CONNECTOR

Figure 6:
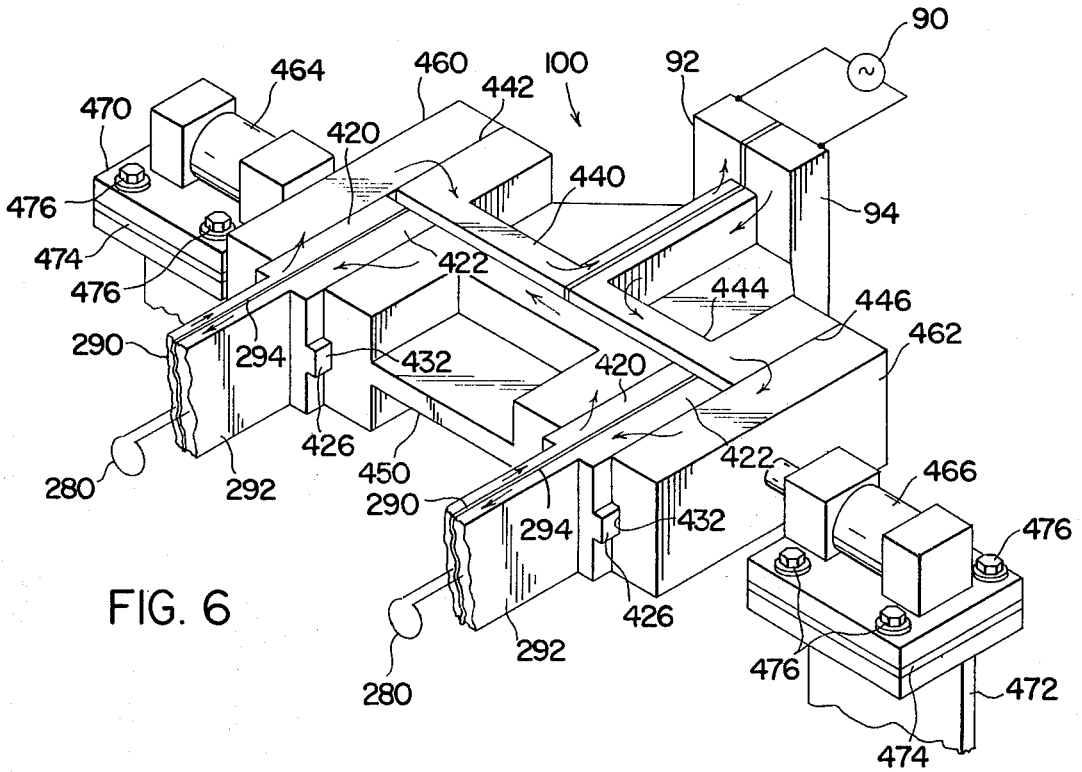
FIG. 6 is a pictorial view illustrating the electrical connection used in the preferred embodiment of the present invention.
Figure 7:
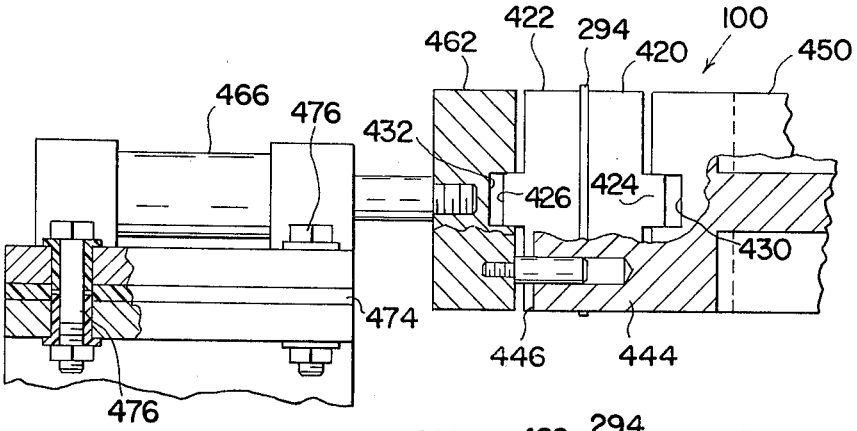
FIG. 7 is a partial cross-sectional view of the structure shown in FIG. 6 illustrating one operating condition of the clamping device.
Figure 7A:
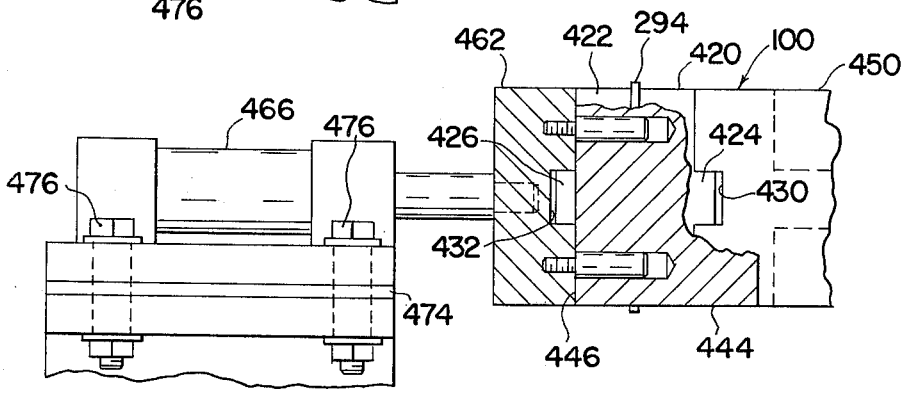
FIG. 7A is a view similar to FIG. 7 illustrating another operating condition of the clamping device.

Referring now to the power connector 100, as shown in FIGS. 6, 7 and 7A, plates or bars 290, 292 are electrically conductive leads connected to the opposite sides of the gap formed in inductors 280. These leads are formed from a conductive material, such as copper, in accordance with induction heating practice. These two leads or plates are secured together at the forward end of carrier 264 and at the rear support 310, best shown in FIGS. 3 and 5. The rear support physically clamps the leads 290, 292 together so that they, in essence, form a rearwardly extending single element which has two spaced conductive portions on opposite sides thereof. This element is movable with the heating units 70, 72. Since the power supply 90 is fixedly secured to extension 114 of base plate 32, a movable electrical connection is required between output leads 92, 94 of the power supply and the clamped element including leads 290, 292. Power connection 100 provides this relative movement without requiring flexible leads. In accordance with this aspect of the invention, the power connector includes means for allowing slidable reciprocation of the plates 290, 292 with respect to the power supply and then provides for clamping the leads in a manner to establish electrical connection between the respective leads and the output leads 92, 94 of power supply 90. A variety of particular structures could be used in accomplishing this function; however, in accordance with the preferred embodiment of the invention, leads or plates 290, 292 include enlarged rear portions 420, 422 each having outwardly extending rails 424, 426. These rails are slidably received within grooves 430, 432 of the power connector 100. Output bar or lead 92 has an arm 440, best shown in FIG. 6, which terminates in an outwardly facing surface 442. In a like manner, output lead or bar 94 has an outwardly extending arm 444 terminating at generally flat surface 446. An intermediate block 450 is positioned between the bar 290 of heating unit 72 and bar 292 of the spaced heating unit 70. In this manner, block 450 has the groove 432 for one bar 292 of heating unit 70, as shown at the left in FIG. 6, and the groove 430 for bar 290 of heating unit 72 positioned at the right of FIG. 6 and as shown in FIGS. 2 and 7. Clamping plates 460, 462 are provided at opposite sides of connector 100. Plate 460 includes a groove 430 for bar 290 of unit 70. Clamping plate 262 has a groove 432 for bar 292 of unit 72. In this manner, the bars connected with inductors 280 are slidably received between a clamping plate, 460 or 462, and intermediate block 450 when pressure is relieved from the two clamping plates. Cylinders 464, 466 have rods which control the position of clamping plates 460, 462 and are positioned on stands 470, 472, respectively. An insulation sheet 474 and insulated bolts 476 support the cylinders 464, 466 in insulated fashion on base plate 32. Appropriate means are provided for holding intermediate blocks 450 in the desired position. During the adjustment and movement of inductors 280, cylinders 464, 466 are slightly retracted to remove pressure from the enlarged portions 420, 422 of leads or bars 290, 292. Thus, these leads or bars can reciprocate with respect to the intermediate block and clamping plates 460, 462. The amount of movement may be different because of the axial spacing of separate buttons 20 of the workpieces. After inductors 280 of the two heating units are in the desired position as shown in FIG. 12D, apparatus A is in proper condition for heating buttons 20. At this time, cylinders 464, 466 force plates 460, 462 against surfaces 442, 446, respectively. The transverse width of enlarged portions 420, 422 are such that this clamping action against surfaces 442, 446 clamps the enlarged portions between the clamping plates 460, 462 and the intermediate block 450. Consequently, electrical circuit is established as shown by the arrows in FIG. 6 to energize both inductors 80 in parallel. After the heating operation has been performed, cylinders 464, 466 are retracted which releases the enlarged portions 420, 422 and allows relative movement of the bars 290, 292 with respect to the remaining structure illustrated in FIG. 6. In this manner, adjustable leads are not required between the power supply 90 and the leads connected with inductors 280 of the two heating units 70, 72.

Having thus defined my invention, I claim:

1. An apparatus for inductively heating the axial generally cylindrical end of an elongated workpiece having a central axis, said end terminating in a generally flat surface generally perpendicular to said axis, said apparatus comprising: means for mounting said workpiece for rotation about the axis of a workpiece being heated; means for rotating the workpiece being heated about said axis; a generally circular inductor for matching said end; means for mounting said inductor generally concentric with said axis; means for moving said inductor in a direction parallel to said axis from a remote position to a position contacting said surface of a workpiece being heated; means for retracting said inductor along said axis and away from said surface a preselected air gap distance; means for energizing said inductor when said inductor is in the retracted position and while said workpiece is rotating, said energizing means including two output leads of a power supply and means for connecting said output leads to said inductor; said connecting means comprising a first element movable with said inductor and having first and second electrically insulated portions; a second element electrically connected to one of said output leads and adapted to engage said first portion; a third element electrically connected to the other of said output leads and adapted to engage said second portion; and means for allowing relative movement of said first element with respect to said second and third elements.

2. An apparatus as defined in claim 1, wherein said first and second portions include means for allowing reciprocal movement axially of said workpiece and with respect to said second and third elements.

3. An apparatus as defined in claim 2 including means for clamping said first element between said second and third elements with said second element engaging said first portion and said third element engaging said second portion and said movement allowing means includes means for releasing said clamping means.

4. An apparatus as defined in claim 1 including means for clamping said first element between said second and third elements with said second element engaging said first portion and said third element engaging said second portion and said movement allowing means includes means for releasing said clamping means.

5. An apparatus for inductively heating the axial, generally cylindrical ends of at least two elongated workpieces, said workpieces each having a central axis and said ends terminating in a generally flat surface generally perpendicular to said axes, said apparatus comprising: means for mounting said workpieces to be heated with the axes of said workpieces to be heated being generally parallel; means for allowing rotation of said workpieces; means for rotating each of said workpieces about its central axis; a generally circular inductor means for heating each of said axial ends of said workpieces to be heated; means for mounting each of said inductor means generally concentric with the central axis of one of said workpieces; means for moving said inductors in unison in a direction corresponding to said axes of said workpieces to be heated from a remote position to a position contacting one of the flat surfaces of the workpieces being heated; means for then locking said inductors with respect to each other; means for retracting said inductor means along said workpiece axes and away from said surfaces a preselected air gap distance; means for energizing each of said inductor means when said inductor means are in the retracted position and while said workpieces are rotating, said energizing means including two output leads of a power supply and means for connecting said output leads to each of said inductor means; said connecting means comprising a first element movable with each of said inductor means and having first and second electrically insulated portions; a pair of second elements each electrically connected to one of said output leads and adapted to engage said first portions; a pair of third elements each electrically connected to the other of said output leads and adapted to engage said second portions; and means for allowing relative movement of said first elements with respect to one of said second elements and one of said third elements.

6. An apparatus as defined in claim 5 wherein each of said first and second portions includes means for allowing reciprocal movement axially of said workpiece and with respect to one of said second elements and one of said third elements.

7. An apparatus as defined in claim 6 including means for clamping each of said first elements between one of said second elements and one of said third elements with said one of said second elements engaging said first portion and said one of said third elements engaging said second portion and said movement allowing means includes means for releasing said clamping means.

8. An induction heating device for heating the end of an elongated workpiece having a central axis, said device comprising: a rod-like member having a first end facing the end of a workpiece to be heated and a second end, said rod-like member being adapted for reciprocation in a direction corresponding to the axis of a workpiece to be heated; a carrier affixed to said first end of said rod-like member; a generally circular inductor for matching said end of said workpiece to be heated; means for securing said inductor onto said carrier in a plane generally perpendicular to the central axis of a workpiece mounted for heating; said inductor having first and second input leads; rigid first and second conductor bars electrically connected to said leads and extending generally parallel to and offset outwardly from said rod-like element; first support means adjacent said carrier for supporting said conductor bars; second support means adjacent said second end of said rod-like member for supporting said conductor bars; and means for connecting said conductor bars to a power supply.

9. A device as defined in claim 8 wherein said connecting means includes first and second spaced elements connected to the output leads of an alternating current power supply; means for reciprocating said conductor bars between said elements; and means for selectively clamping said elements against said bars with said first spaced element engaging said first conductor bar and said second spaced element engaging said second conductor bar.

* * * * *